United States Patent [19]

Meyer et al.

[11] 4,236,651

[45] Dec. 2, 1980

[54] DISPENSER DEVICE WITH VALVE PISTON PUMP

[75] Inventors: Walter Meyer, Triengen; Anton J. Bara, Büron, both of Switzerland

[73] Assignee: Trisa Bürstenfabrik A.G., Triengen, Switzerland

[21] Appl. No.: 67,288

[22] Filed: Aug. 17, 1979

Related U.S. Application Data

[63] Continuation of Ser. No. 801,421, May 27, 1977, abandoned, which is a continuation-in-part of Ser. No. 704,939, Jul. 13, 1976, Pat. No. 4,068,974.

[30] Foreign Application Priority Data

Jun. 8, 1976 [CH] Switzerland ..... 7184/76

[51] Int. Cl.[3] ..... B67B 7/24; B67D 5/42

[52] U.S. Cl. ..... 222/82; 222/83.5; 222/321; 222/325; 222/383; 401/135; 401/178; 401/270

[58] Field of Search ..... 222/82, 83.5, 88, 321, 222/325, 340, 341, 377, 378, 383, 385, 402.2, 547, 564; 417/552, 553; 401/134, 135, 150, 178, 270

[56] References Cited

U.S. PATENT DOCUMENTS

| | | | |
|---|---|---|---|
| 2,323,378 | 7/1943 | Champion et al. | 222/321 |
| 2,328,048 | 8/1943 | Bair | 401/150 |
| 2,547,109 | 4/1951 | Bacheller | 222/321 X |
| 2,776,785 | 1/1957 | Lyon | 222/378 X |
| 3,158,179 | 11/1964 | Lehmann | 222/402.2 X |
| 3,187,960 | 6/1965 | Gorman | 222/383 X |
| 3,211,346 | 10/1965 | Meshberg | 222/341 X |
| 3,228,571 | 1/1966 | O'Donnell et al. | 222/385 X |
| 3,391,647 | 7/1968 | Corsette et al. | 222/385 X |
| 3,441,177 | 4/1969 | Treharne, Jr. | 222/82 |
| 3,877,616 | 4/1975 | Stevens | 222/321 |
| 3,910,706 | 10/1975 | Del Bon | 401/134 |

*Primary Examiner*—Robert J. Spar
*Assistant Examiner*—Fred A. Silverberg
*Attorney, Agent, or Firm*—Werner W. Kleeman

[57] ABSTRACT

A dispenser device comprising a reservoir for a flowable or fluent filled material as well as a piston pump equipped with a valve arrangement. The valve arrangement is coaxially dispositioned with regard to the pump and possesses parts connected with the piston and parts connected with the cylinder of the piston pump.

24 Claims, 9 Drawing Figures

Fig. 1
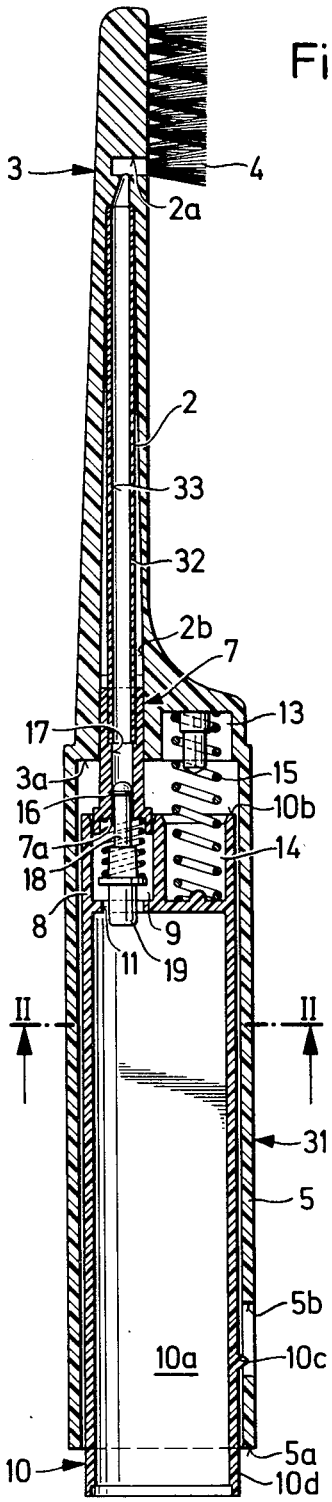
Fig. 2
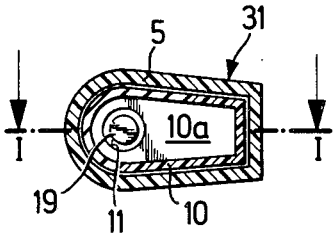
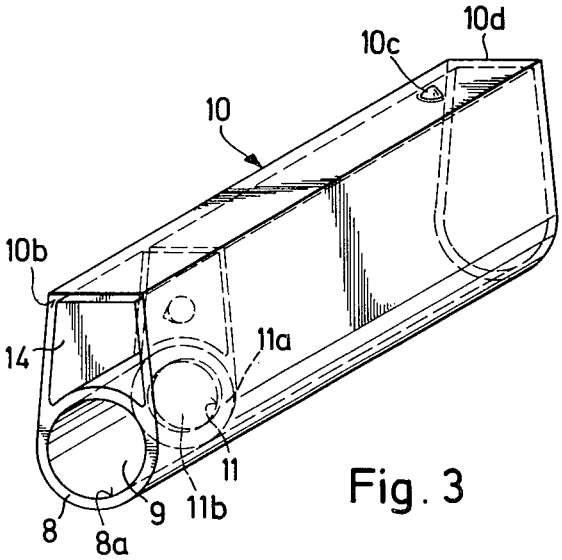
Fig. 3

DISPENSER DEVICE WITH VALVE PISTON PUMP

CROSS-REFERENCE TO RELATED UNITED STATES APPLICATIONS

This application is a continuation patent application of our commonly assigned U.S. application Ser. No. 801,421, filed May 27, 1977, entitled "DISPENSER DEVICE WITH VALVE PISTON PUMP" now abandoned, which, in turn, is a continuation-in-part application of commonly assigned, U.S. application Ser. No. 704,939, filed July 13, 1976, and entitled "FOUNTAIN TOOTHBRUSH HAVING BRISTOL CARRIER EASILY PRODUCIBLE BY INJECTION MOLDING", now U.S. Pat. No. 4,068,974, the disclosure of which is incorporated herein by reference.

BACKGROUND OF THE INVENTION

The present invention relates to a new and improved construction of dispenser device of the type comprising a reservoir for a fluent or flowable filled material i.e. a material which is to be dispensed as well as containing a piston pump equipped with a valve arrangement.

Dispenser devices of this type are known to the art in numerous constructional embodiments. They are typically quite complicated in construction and accordingly expensive. Furthermore, they simultaneously markedly inhibit the free construction or design of the apparatus with which such dispenser devices are employed. Thus, it is for instance difficult to construct the reservoir as a cartridge, since for the purpose of connecting the same with the pump there is required a detachable conduit connection. Moreover, the valve arrangement of the state-of-the-art dispenser devices employ automatically activated or even better stated pressure-activated valves, since the positive actuation of the valves requires a complicated valve mechanism which cannot readily be employed for spatial, cost or also functional reasons.

SUMMARY OF THE INVENTION

Hence, it is a primary object of the present invention to provide a new and improved construction of dispenser device which is not associated with the aforementioned drawbacks and limitations of the prior art proposals.

Another significant object of the present invention aims at the provision of a new and improved construction of dispenser device which aims at minimizing the problems associated with the prior art dispenser devices.

Yet a further important object of the present invention is to devise a dispenser device with is relatively simple in construction and design, economical to manufacture, easy to use, not readily subject to malfunction or breakdown, and provides for a positive dispensing action of a fluent material which is to be dispensed.

Now in order to implement these and still further objects of the invention, which will become more readily apparent as the description proceeds, the dispenser device of this development is manifested by the features that the valve arrangement is coaxially disposed with respect to the piston pump which comprises a piston and cylinder arrangement and such valve arrangement has parts connected with the piston as well as parts connected with the cylinder.

With such construction the fabrication of the dispenser devices is particularly simple, since the aforementioned parts of the valve arrangement can be already formed by appropriate construction of the pump parts or components.

Furthermore, the relative movement of the pump parts can be designed such that they can be accomplished practically without any additional complications concerning the positive valve actuation. In addition to the functional reliability which is obtained there is also increased the dosing accuracy and the dispensing action can be rendered substantially independent of the viscosity of the filled material. Furthermore, the reservoir can be readily constructed as a cartridge, since with the previously discussed construction the piston pump and the pump cylinder can form a detachable conduit connection which is situated between the inlet and the outlet of the valve arrangement. This allows installing the cartridge in the handle of the related device and to use such as the actual actuation element both for the pump as well as also for the valve arrangement.

The foregoing design provides a dispenser device which is constructed exceedingly simply, but however, exhibits maximum functional integrity or reliability, and this is so even to the extent that there is prevented in any event any undesired flowing out of the material to be dispensed, but the dispensing thereof however is insured in a reliable manner and with the desired dosage. In particular, the one pump part or component can be equipped with a valve body which can be displaced against spring force. At the end of the pumping stroke this valve body closes off an opening connecting the cylinder chamber or space with the reservoir and again frees such opening during the return stroke of the pump, so that even relatively viscous filled material can easily be delivered into the cylinder compartment. The relevant pump part or component which is equipped with the valve body furthermore can support the one part or component of the outlet valve, for instance, the seat of such outlet valve, against which there sealingly comes to bear an associated valve head during the return stroke of the piston. During the forward stroke of the relevant pump part the valve head is lifted from its seat by the valve body and the outlet from the cylinder compartment is completely freed.

The fields of application of such dispensing device are numerous. In order to more fully explain the different details thereof there will be considered hereinafter, only by way of illustration and not limitation, a toothbrush equipped with the previously described dispenser device of the invention and an appropriately constructed spray can.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a longitudinal sectional view of a preferred embodiment of fountain toothbrush equipped with a bristle carrier having a handle and a replaceable cartridge not integral therewith and serving as a reservoir;

FIG. 2 is a cross-sectional view through the cartridge and the guide sleeve surrounding it shown in FIG. 1, taken substantially along the line II—II thereof;

FIG. 3 is a perspective view of the cartridge shown in FIG. 1;

DETAILED DESCRIPTION OF THE PREFERRED EMBODIMENTS

Figure 4:
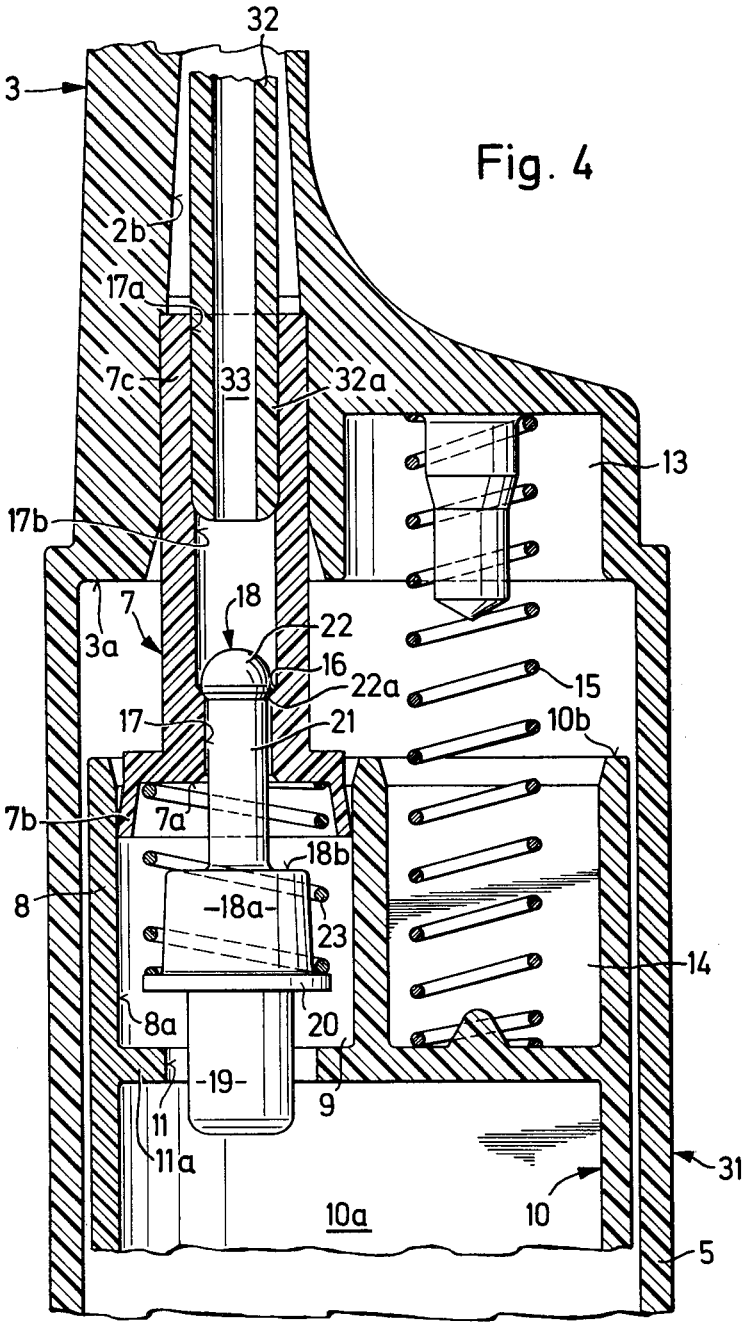
FIG. 4 is an enlarged longitudinal sectional view of the zone of the toothbrush in which the bristle carrier and the cartridge engage one another, wherein the cartridge is in a position in which it protrudes from the open end of the handle part of the bristle carrier.

Describing now the drawings, the exemplary embodiment of dispenser device shown by way of example as a fountain toothbrush in FIGS. 1 and 2 will be seen to comprise as its main parts or components a bristle carrier 3 which carries at its one forward end a set of bristles 4. This bristle carrier or support 3 possesses about the face or end surface 3*a* which faces away from the end carrying the bristles 4 an extension in the form of a rigid-walled sleeve 5 which simultaneously serves as a handgrip or handle and is open at its rear end 5*a*. A cartridge 10 containing the filled material i.e. the material which is to be dispensed, in this case a liquid or pasty dentifrice is inserted through the open handle end 5*a*. A duct or passageway 2 extends through the bristle carrier 3 from its rear end face 3*a* up to the region of the bristle-carrying end of such bristle carrier 3 and opens by means of a lateral outlet channel or duct 2*a* between the bristles 4. Moreover, the cross-section or diameter of the duct or passageway 2 is structured at one location preferably in such a manner that it exerts a capillary action on the dentifrice flowing therethrough depending upon the viscosity of the latter. By virtue of these measures there is extensively avoided unintentional flow of dentifrice out of the outlet opening of the outlet duct or channel 2*a* when the dispenser device, in this case the fountain toothbrush, is in its non-actuating position, even when the fountain toothbrush is held with the bristles 4 pointing downwards and is shaken or jarred or flung about.

A piston 7 having an axial passage or passageway 17 is pressed with a tight fit into the widened end region or throughflow end 2*b* of the duct or passageway 2. The dentifrice-containing cartridge 10 is inserted in the sleeve 5 forming the handle and possesses at its end wall 10*b* directed towards the interior of the sleeve 5 a throughflow chamber or a cylinder sleeve part or connection 8. The cylinder sleeve part or connection 8 has an internal chamber or passage 9 which flow communicates with the internal space or chamber 10*a* of the cartridge 10 by means of an opening 11. The cylinder sleeve part 8 is arranged in the inner end wall 10*b* of the cartridge 10 in such a manner, and its diameter is designed such, that upon insertion of the cartridge 10 the piston 7 enters the cylinder sleeve part 8 and can sealingly slide therein. The cylinder sleeve part or connection 8 thus forms a pump cylinder which is associated with the piston 7. Prior to its insertion into the sleeve 5, a new, dentifrice-filled cartridge 10 is sealed by a membrane-like closure 11*b* across the opening 11, as best seen by referring to FIG. 3. The path of insertion of the cartridge 10 is limited by a nose or nose member 10*c* provided on the outer cartridge wall, this nose member being snapped into a groove or recess 5*b* of the wall of this sleeve 5, and also is limited by impact of the nose 10*c* against the end wall of the groove 5*b* which is displaced forwards in axial direction, i.e. towards the bristles 4.

A recess 13 provided in a part of the rear end wall 3*a* of the bristle carrier 3 and located internally of the sleeve 5 defining the handle and another recess 14 provided at an oppositely situated front end wall 10*b* of the cartridge 10 facing towards the bristles 4 are aligned with one another and receive therein, respectively, the opposite ends of a compression spring 15 which serves as a return spring for urging the bristle carrier 3 and the cartridge 10 apart. The displacement of the cartridge 10, due to the action of the compression spring 15, outwardly of the open rear end of the sleeve 5 is limited by the abutment of nose 10*c* of the cartridge 10 against the transverse rear end wall of the groove 5*b*. Consequently, cartridge 10 is prevented from dropping out of the handle formed by the sleeve 5. On the other hand, when pulling more intensely on the rear end of the cartridge 10 protruding from the open end of the sleeve 5, the somewhat flexible nose 10*c* can be forced to slip out of the groove 5*b*, and thus for instance it is possible to remove an empty cartridge from the sleeve 5 and to replace the same by a new, full cartridge. Instead of constructing the nose 10*c* to be flexible or resilient, it is equally possible to also design the wall of the cartridge 10 to be somewhat flexible or resilient, especially in the vicinity of the nose 10*c* in order to serve the same purpose.

Now if instead of the groove 5*b* there is provided a window as shown in FIG. 1, then the nose 10*c* can be pressed slightly inwardly e.g. with a fingertip and at the same time can be disengaged or dislodged from the groove 5*b* by simply pushing it outwardly, whereupon the cartridge 10 can be easily pulled out of the sleeve 5. For this purpose, the window 5*b* also can be located near the other end of the sleeve 5 e.g. towards its central or middle region. A pin or mandrel pin means 19 which projects outward of the end face or side 7*a* of the piston 7 which is located opposite the cartridge 10 serves to rupture the previously discussed cartridge membrane 11*a* when the cartridge 10 is inserted far enough into the sleeve 5. Preferably this occurs at the same time as the nose 10*c* snaps into the groove or window 5*b*, or however shortly beforehand.

During the manufacture of the bristle carrier 3 together with the sleeve 5 of the previously described fountain toothbrush, difficulties are associated with the manufacture of the narrow, long duct or passageway 2, because the required long, thin core needle used during injection molding can easily break or become bent. Hence, the passageway or duct 2 is manufactured of a larger diameter than is desirable for a controlled outflow of the material to be dispensed, here the dentifrice. Thus, in the wide passageway or duct 2 there can be fixedly inserted a conduit element 32, preferably in the form of a hollow needle having a narrow axial channel 33 therethrough. In the widened region or zone 2*b* of the passageway or duct 2 which is situated towards the bristle carrier-end wall 3*a* there is fixedly seated or otherwise fixedly connected, upon the end 32*a* (FIG. 4)

of the conduit element 32 which protrudes out of the region 2b of such duct 2, the open end 7c of the piston 7 which confronts the bristle carrier 3.

At end surface or face 7a confronting the cartridge 10 the piston 7 is equipped with a circumferential elastic sealing rim or edge 7b. This sealing rim or edge 7b sealingly bears against and is guided at the inner wall 8a of the cylinder chamber 9 of the cylinder sleeve part or connection 8.

The axial piston passage 17 which extends through the piston 7 opens at one end at the center of the piston end or frontal face 7a and is provided at the middle or central zone of the piston 7 with a conically bevelled ring or annular shoulder 16. This annular shoulder 16 serves as a valve seat and merges with the throughpassage region or passage zone 17b of wider diameter, and which zone extends from the ring shoulder 16 to the passage opening or throughpassage opening 17a facing towards the bristles 4.

In the throughpassage 17 there is housed a valve body 18 possessing a sealing portion 18a of larger diameter and a sealing disc or gasket 20. The latter can sealingly bear at the inner surface of the transverse wall 11a separating the interior of the cylinder chamber 9 from the interior 10a of the reservoir in the cartridge 10, thereby closing the opening 11 located in such transverse wall 11a. At the abutting or sealing disc 20 there is provided pin 19 which protrudes into the opening 11 and by means of the latter into the interior or inner space 10a of the cartridge 10. The diameter of the pin 19 is slightly smaller than that of the opening 11.

The upperside 18b of the sealing ring portion 18a, which side confronts the bristles 4, can be brought into abutting contact with the end face or wall 7a of the piston 7 and carries a valve stem 21 which protrudes into the piston passage 17 past the valve seat 16 in the direction of the bristles 4. The wall 7a and upperside 18b of the sealing ring 18a form stop means for limiting the movement of the valve body 18. The valve stem 21 is enlarged at its one end in the form of a head 22 defining a closure member and possesses at the side of the head which faces away from its end a preferably conically bevelled valve sealing surface or face 22a. The latter is constructed such that it can sealingly bear upon the valve seat 16. At least one of the valve seat 16 or closure members 22 is elastically deformable so that the closure member can be inserted through the valve seat.

The spacing between the contact surface of the abutting sealing disc 20 at the opening 11 and the valve sealing surface 22a of the head 22 of the valve body 18, on the one hand, and the spacing between the end surface 7a and the valve seat 16, on the other hand, are dimensioned such that when the piston 7 sealingly bears with its end wall or face 7a at the upperside 18b of the sealing ring portion or part 18a and, when the outer face or surface of the abutting sealing disc 20 sealingly bears at the transverse wall 11a of the cylinder sleeve part or cylinder chamber 8, and which transverse wall 11a contains the opening 11, the valve head 22 is lifted from the valve seat 16. This occurs against the force of a valve resetting spring 23 which is arranged between the upperside of the abutting sealing disc 20 directed towards the piston 7 and the end wall 7a of the piston 7 and strives to sealingly press the valve head 22 against the valve seat 16.

Figure 6:
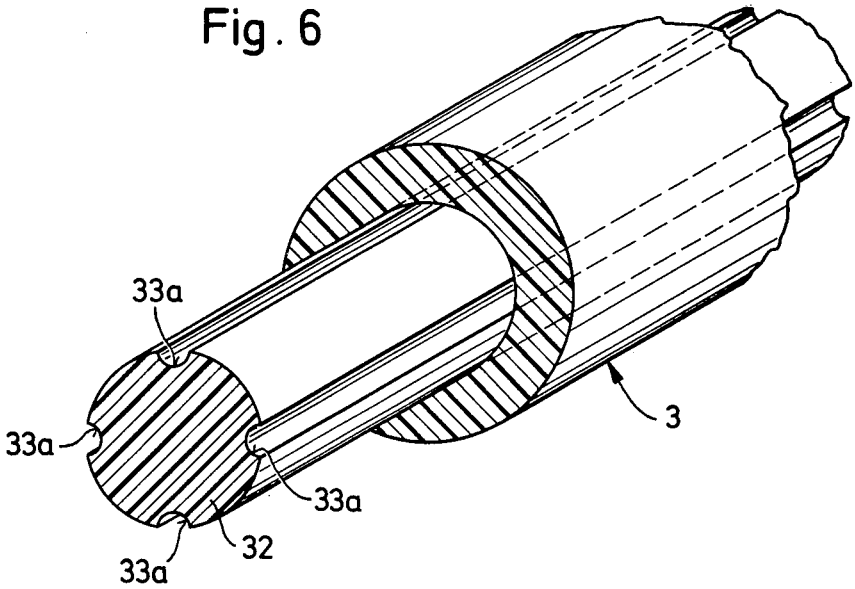
FIG. 6 is a perspective partial view of another exemplary embodiment of the conduit member provided in the bristle carrier.
Figure 7:
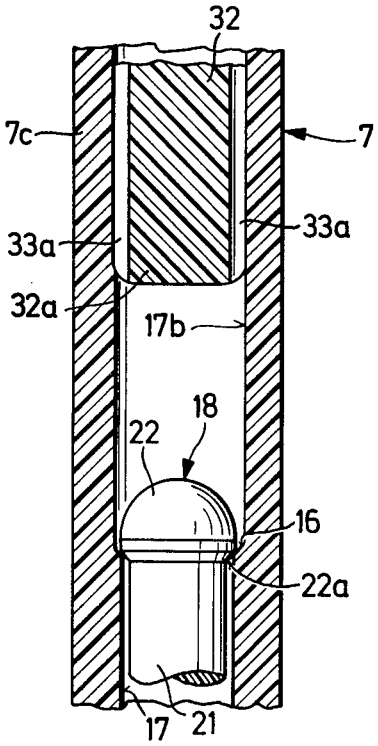
FIG. 7 is a longitudinal sectional view of a part of the piston having inserted therein a part of the embodiment of a conduit element as shown in FIG. 6.

In lieu of a single central throughflow channel 33 there can be provided in the outer wall of the conduit element 32 also two or more, for instance four longitudinal grooves 33a, as best seen by referring to FIGS. 6 and 7. In the end region 32a of the conduit element 32 these longitudinal grooves 33a are covered by the inner wall of the passage 17 in the open end region 7c of the piston 7 and downstream thereof are covered by the inner wall of the duct or passageway 2 in the bristle carrier 3 and, thus, form a multiplicity of throughflow channels, the individual cross-sectional areas of which can be held so small by providing correspondingly flatter or narrower cross-sections of the grooves 33a that they strive to carry out a desired capillary effect on the liquid dentifrice.

Figure 5:
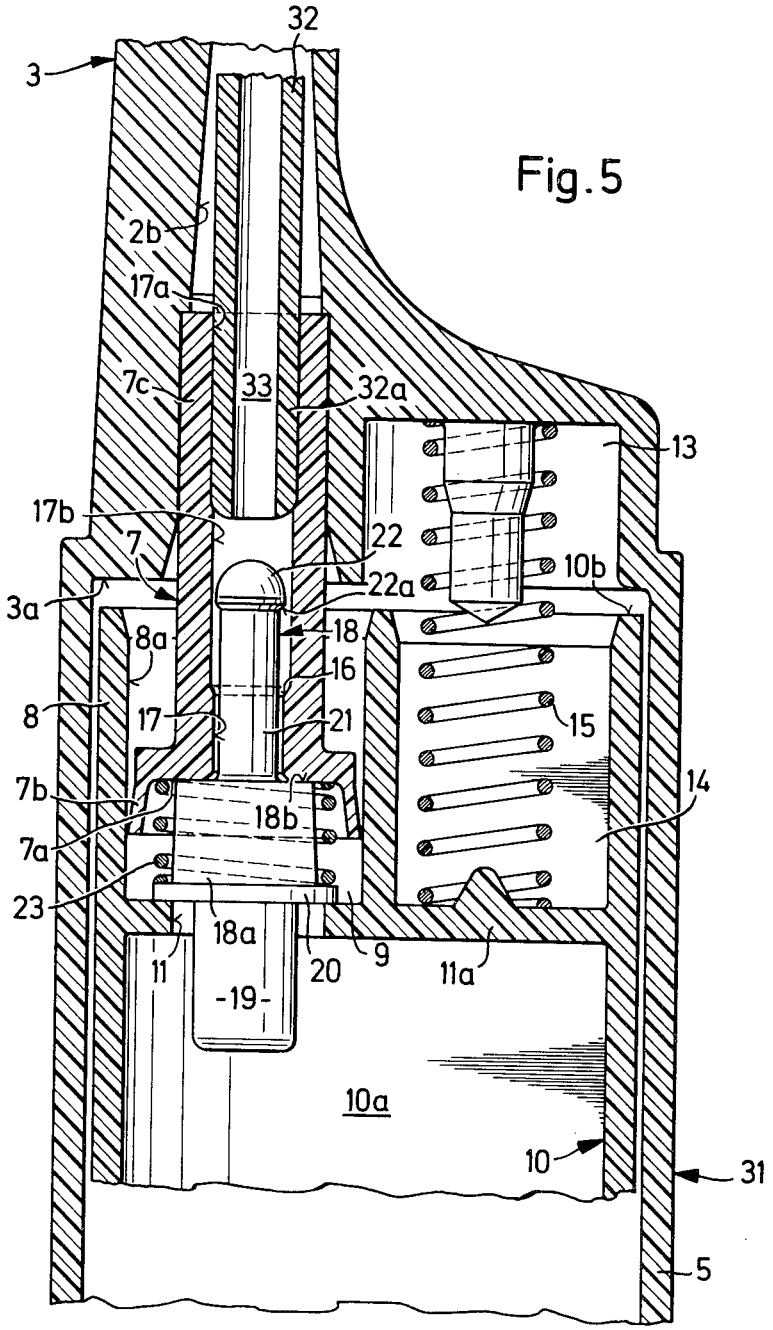
FIG. 5 illustrates a similar longitudinal sectional view as shown in FIG. 4, but with the cartridge urged into the handle part of the bristle carrier.

Having now had the benefit of the foregoing description of the exemplary embodiment of dispensing or dispenser unit in the form of a fountain toothbrush the same is used in practice in the following manner:

Initially during introduction of the cartridge 10 into the handle formed by the sleeve 5, while piercing the membrane 11b closing the opening 11 by means of the pin 19 which is held in position relative to the cartridge 10 owing to the abutment of the sealing part 18a at the base portion 7a of the piston 7, the bristle carrier 3 and the cartridge 10 assume the position depicted in FIG. 5. In this position the abutting gasket disc 20 closes the opening 11 against which it has already been pressed approximately prior to reaching the position of FIG. 5 by means of the compressed valve compression spring 23. Now if under the action of the stronger return or restoring spring 15 the cartridge 10 is moved within the sleeve 5 away from the end surface or face 3a of the bristle carrier 3, then such cartridge also moves relative to the piston 7 which thus sealingly bears in contact with the sealing rim 7b at the inner wall 8a of the cylinder chamber 9 until it has reached the position shown in FIG. 4. During this movement the abutting gasket disc 20 initially still retains the opening 11 closed in that the spring 23 is not completely untensioned, even when the valve head 22 has already reached the valve seat 16.

During further displacement of the cartridge 10 by the compression spring 15 the valve body 18 is fixedly held by means of the valve sealing surface 22a at the valve seat 16 and the sealing disc 20 frees the opening 11. Consequently, when the toothbrush is held with the bristles 4 directed downward even a viscous dentifrice or other material to be dispensed will be suctioned into the pumping space defined by the cylinder chamber 9. Any air which is present in the pumping space of the cylinder chamber 9 ascends in the form of bubbles to the outer, upper end 10b of the cartridge 10 (FIG. 4).

Now if during application of pressure upon the protruding end 10d of the cartridge 10 the piston 7 is again shifted in the cylinder chamber 9 into the position shown in FIG. 5, then initially the opening 11 is closed due to abutment of the abutting disc 20 and then during the further course of the cartridge- and piston movement, respectively, the spring 23 is compressed and thus the valve seat 16 is moved away from the valve head 22. During progressive penetration of the piston 7 into the pumping or cylinder chamber 9 liquid is forced between the valve seat 16 and the valve head 22 and pressed into the throughflow channel 33 until the end face or wall 7a abuts against the upperside or stepped portion 18b of the ring-shaped or annular part 18a.

Upon release of the cartridge the cylinder chamber forming sleeve part 8 and the piston 7 again return from the position shown in FIG. 5 back into the position shown in FIG. 4 and the fountain toothbrush is again ready for dispensing a new dose of liquid dentifrice to the bristles 4.

A fountain toothbrush having a piston part introducible into a rigid-walled rearwardly closed reservoir and a valve mounted in the frontal wall of the piston part has been descrived in U.S. Pat. No. 3,227,165 to Constanza. However, with this prior art fountain toothbrush, the valve consists of a slotted rubber valve which does not allow for any dosed dispensing of the liquid dentifrice to the bristles.

Good closure of the opening 11 of the cartridge 10 is of decisive importance for the positive functioning, especially also for the exact dosed delivery of liquid for the fountain toothbrush of the present invention. To this end there is required a sufficiently strong spring 23 and a sufficiently narrow intermediate space between the valve stem 21 and the inner wall 17*b* of the axial piston passage 17.

In order to demonstrate the manifold possible fields of application of the described dispenser device, there will hereinafter be considered a number of other applications. The handle of the illustrated fountain toothbrush with the valve arrangement housed therein and the cartridge can be used, for instance, directly as the bristle carrier for a hand brush or the like. Such handle or handgrip furthermore could possess a particular aesthetic construction, wherein the cartridge can contain cosmetics or the like. In the same manner it is however also possible to use the dispenser device for the dispensing of medication, by virtue of the dosage accuracy. The particular characteristics or aspects of the invention come fully into play especially when using the same in the environment of a fountain toothbrush, since such device often is carried in a pocket book or the pocket of a jacket or the like, so that there must be present both positive operation reliability in conjunction with absolute lack of leakage of the material to be dispensed. It has been found in practice that in the case of a fountain toothbrush, as previously described, these requirements are totally fulfilled.

Figure 8:
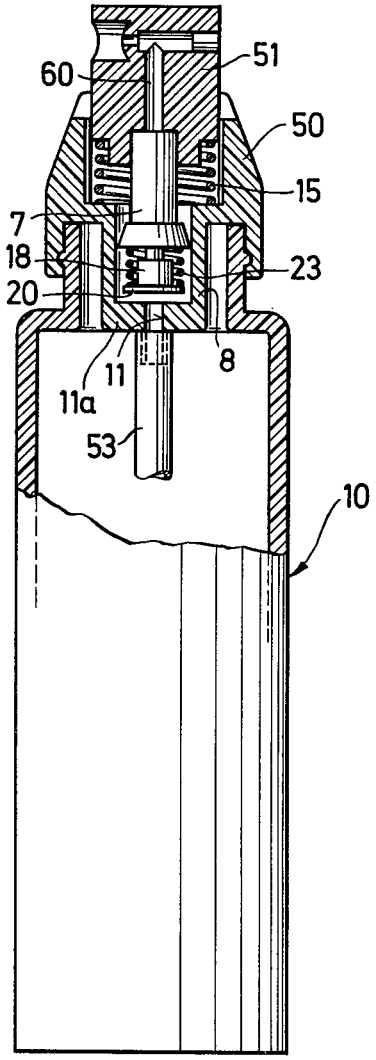
FIG. 8 is a longitudinal sectional view of a spray can employing the teachings of the invention.
Figure 9:
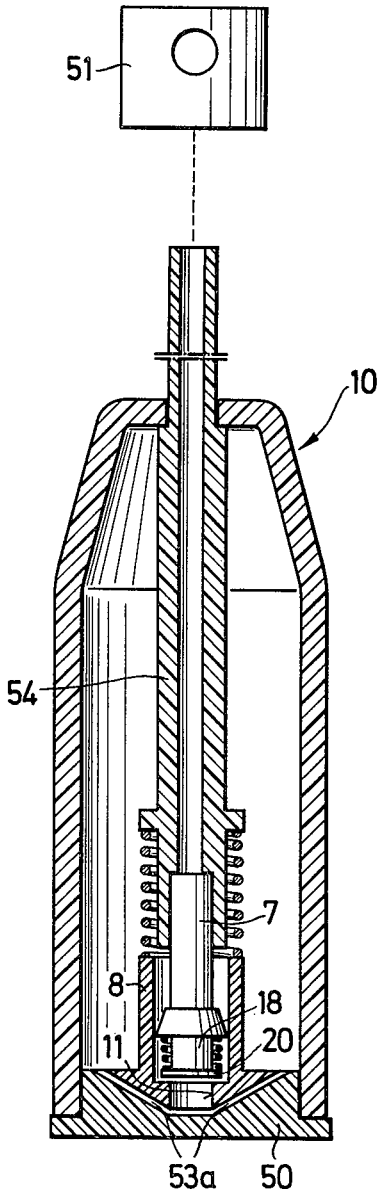
FIG. 9 is a modified version of spray can utilizing the inventive teachings.

What has been explained heretofore is analogously applicable with regard to the embodiments of spray cans shown in FIGS. 8 and 9. As a matter of simplicity the same or slightly modified reference characters have been conveniently employed for the same components, so that further detailed explanations are not believed to be necessary beyond what is stated hereinafter. The pump is accommodated in a container cap or closure 50 which is attached at the reservoir or cartridge, possibly so as to be exchangeable. The piston 7 engages by means of its piston rod 60 into an actuation part or component 51. A hose 53 merges with the opening 11.

With the embodiment of FIG. 9 the closure 50 is provided at the end of the cartridge or reservoir 10 which faces away from the actuation part 51. Instead of using the hose 53, in this case there are provided the connection channels 53*a*. The piston 7 is connected with the actuation part by means of a tube 54.

The narrow passage moreover forms an especially effective throttle location or throttle means, also upon release of the cartridge, and which prevents sucking-up of undesirable amounts of air. The negative pressure which prevails in the cylinder compartment due to the throttling action can bring about lifting of the valve plate or sealing disc 20 from its seat before the valve head 22 will be seated upon its seat 16.

While there are shown and described present preferred embodiments of the invention, it is to be distinctly understood that the invention is not limited thereto, but may be otherwise variously embodied and practiced with the scope of the following claims. ACCORDINGLY,

What we claim is:

1. A dispenser device for dosed dispensing of a fluent material, comprising:

reservoir means for containing the fluent material;

a piston pump having a cylinder part and a piston part which are movable relative to one another for selectively performing a suction stroke and a dispensing pumping stroke;

a valve arrangement having an inlet valve and an outlet valve;

said outlet valve being arranged in the piston part and said inlet valve being arranged in the cylinder part;

each valve having a closure member, the two closure members being connected with one another by a valve stem for common actuation in the same direction;

said two closure members together with the valve stem forming a valve body;

each closure member coacting with a valve seat arranged at the cylinder part and the piston part, respectively;

a first spring means, arranged between the closure member of the inlet valve and one end of the piston part, for bearing at one end against said closure member of the inlet valve and at the other end against said one end of the piston part;

said first spring means, in the rest condition of the piston pump, maintaining said outlet valve closed and being compressed after closing of the inlet valve for keeping the inlet valve closed;

said reservoir means having an outlet opening means for forming the valve seat of the inlet valve;

said cylinder part of the piston pump being in fluid flow connection with the reservoir means and having a cylinder chamber communicating with said outlet opening means;

said valve body being coupled with the piston part of the piston pump and being displaceable relative thereto against the pressure of said first spring means during said dispensing pumping stroke; and a second spring means acting between said piston part and said cylinder part for resiliently moving the piston part and the cylinder part relative to one another during the suction stroke.

2. The dispenser device according to claim 1, characterized in that the valve body is limited in its movement against the first spring means by stops.

3. The dispenser device according to claim 2, characterized in that the stops are formed by a shoulder of the valve body and by a base of the piston part.

4. The dispenser device according to claim 1, characterized in that the cylinder part is formed by a connection completely surrounding the outlet opening means and which connection is attached at the reservoir means.

5. The dispenser device according to claim 1, characterized in that the piston part has an axial passageway provided with the valve seat thereof and into which axial passageway extends the valve stem.

6. The dispenser device according to claim 5, characterized in that one of the valve seat and the closure member of the outlet valve is elastically deformable so that the closure member can be inserted through the valve seat.

7. The dispenser device according to claim 1, characterized in that a throttle location is provided between the outlet valve and the cylinder chamber.

8. The dispenser device according to claim 1, characterized in that said reservoir means is constructed as an exchangeable cartridge.

9. The dispenser device according to claim 8, characterized in that said outlet opening means of the reservoir means is sealed by a rupturable membrane-like closure means.

10. The dispenser device according to claim 9, characterized in that the valve body has a mandrel pin means for confronting the outlet opening means and for rupturing the rupturable membrane-like closure means.

11. The dispenser device according to claim 1, characterized in that the piston part of piston pump has a hollow piston rod which engages on its internal wall a conduit means for projecting into a channel in a bristle carrier.

12. The dispenser device according to claim 11, characterized in that the conduit means includes an outlet opening at a region of the bristle set.

13. The dispenser device according to claim 12, characterized in that the conduit means includes groove means for forming at least one capillary channel.

14. The dispenser device according to claim 13, characterized in that the at least one capillary channel extends between an outer surface of the conduit means and a wall of the channel in the bristle carrier.

15. A brush having a bristle carrier carrying a bristle set comprising:

reservoir means for dispensingly housing the fluent material;

a piston pump having a cylinder part and a piston part which are movable relative to one another for selectively performing a suction stroke and a dispensing pumping stroke;

a valve arrangement having an inlet valve and an outlet valve;

said outlet valve being arranged in the piston part and said inlet valve being arranged in the cylinder part;

each valve having a closure member, the two closure members being connected with one another by a valve stem for common actuation in the same direction;

said two closure members together with the valve stem forming a valve body; each closure member coacting with a valve seat arranged at the cylinder part and the piston part, respectively;

a first spring means, arranged between the closure member of the inlet valve and one end of the piston part, for bearing at one end against said closure member of the inlet valve and at the other end against said one end of the piston part;

said first spring means, in the rest condition of the piston pump, maintaining said outlet valve closed and being compressed after closing of the inlet valve for keeping the inlet valve closed;

said reservoir means having an outlet opening means for forming the valve seat of the inlet valve;

said cylinder part of the pump being in fluid flow connection with the reservoir means and having a cylinder chamber communicating with said outlet opening means;

said valve body being coupled with the piston part of the piston pump and being displaceable relative thereto against the pressure of said first spring means during said dispensing pumping stroke; and a second spring means acting between said piston part and said cylinder part for resiliently moving the piston part and the cylinder part relative to one another during the suction stroke.

16. The brush according to claim 15, characterized in that the valve body is limited in its movement against the first spring means by stops.

17. The brush according to claim 16, characterized in that the stops are formed by a shoulder of the valve body and by a base of the piston part.

18. The brush according to claim 15, characterized in that the cylinder part is formed by a connection completely surrounding the outlet opening means and which connection is attached at the reservoir means.

19. The brush according to claim 15, characterized in that the piston part has an axial passageway provided with the valve seat thereof and into which axial passageway extends the valve stem.

20. The brush according to claim 19, characterized in that one of the valve seat and the closure member of the outlet valve is elastically deformable so that the closure member can be inserted through the valve seat.

21. The brush according to claim 15, characterized in that a throttle location is provided between the outlet valve and the cylinder chamber.

22. The brush according to claim 15, characterized in that said reservoir means is constructed as an exchangeable cartridge.

23. The brush, according to claim 22, characterized in that said outlet opening means of the reservoir means is sealed by a rupturable membrane-like closure means.

24. The brush according to claim 23, characterized in that the valve body has a mandrel pin means for confronting the outlet opening means and for rupturing the rupturable membrane-like closure means.

* * * * *